US005724082A

United States Patent [19]

Moynihan

[11] Patent Number: 5,724,082

[45] Date of Patent: Mar. 3, 1998

[54] FILTER ARRANGEMENT FOR INK JET HEAD

[75] Inventor: Edward R. Moynihan, Plainfield, N.H.

[73] Assignee: Specta, Inc., Keene, N.H.

[21] Appl. No.: 231,102

[22] Filed: Apr. 22, 1994

[51] Int. Cl.[6] ..... B41J 2/175

[52] U.S. Cl. ..... 347/88; 347/93

[58] Field of Search ..... 347/93, 89, 92, 347/88

[56] References Cited

U.S. PATENT DOCUMENTS

| | | | |
|---|---|---|---|
| 4,233,610 | 11/1980 | Fischbeck et al. | 347/94 |
| 4,940,995 | 7/1990 | Hine et al. | 347/88 |
| 5,023,630 | 6/1991 | Moriyama | 347/93 |
| 5,189,438 | 2/1993 | Hine et al. | 347/89 |
| 5,296,875 | 3/1994 | Suda | 347/93 |
| 5,409,138 | 4/1995 | Nakano | 347/93 |
| 5,457,485 | 10/1995 | Moriyama et al. | 347/93 |

FOREIGN PATENT DOCUMENTS

| | | | |
|---|---|---|---|
| 54-53832 | 4/1979 | Japan | 347/93 |

*Primary Examiner*—John E. Barlow, Jr.
*Attorney, Agent, or Firm*—Brumbaugh, Graves, Donohue & Raymond

[57] ABSTRACT

In the embodiments described in the specification, an ink jet head has an orifice filter disposed between a pressure chamber and an orifice to trap contaminant particles having a size likely to block the orifice, while permitting smaller particles to pass through the filter, thereby preventing blocking of the orifice while avoiding substantial pressure drop in the pulses producing ejection of drops from the orifice. In addition, a separate filter having a substantially smaller pore size is incorporated in a reservoir from which ink is supplied to the pressure chamber, thereby filtering out small particles which might accumulate to produce orifice-blocking particles.

6 Claims, 1 Drawing Sheet

FILTER ARRANGEMENT FOR INK JET HEAD

BACKGROUND OF THE INVENTION

This invention relates to arrangements for filtering ink in ink jet heads to prevent clogging of ink jet orifices.

In ink jet systems, ink is ejected in the form of drops from a series of small orifices which may have a diameter of, for example, 0.020–0.060 mm, in response to selectively applied electrical pulses actuating a pressure transducer in a pressure chamber adjacent to each orifice. After ejection of an ink drop from an orifice, the ink in the associated pressure chamber is replenished from an ink reservoir in the ink jet head, which in turn is periodically refilled from a remote ink supply.

One of the fundamental practical problems with ink jet technology is clogging of the small orifices in the ink jet head with contaminants carried in the ink flowing to the orifices. Such contaminants may originate in the ink supplied to the ink jet head or in air supplied to the ink reservoir as ink is withdrawn from it or they may be introduced into the ink passages in the ink jet head during assembly of the head. Regardless of the source of contaminants which can clog the orifices, it is essential to prevent such orifice-clogging, since the clogging of even a single orifice in an array containing, for example, 96 orifices, renders the head useless.

To avoid orifice-clogging by contaminants in the ink supplied to an ink jet head, the ink reservoir in the head normally contains a fine filter having a pore size substantially smaller than the orifice size, for example, 0.002–0.005 mm, by which solid particles of larger size entering the reservoir are screened out and prevented from reaching the orifices. Because such reservoir filters extend over a large area, and also because the reservoir is normally open to the atmosphere, the flow of ink from the reservoir to the pressure chambers and the orifices is not inhibited by the small size of the pores in the filter. Such reservoir filters, however, cannot prevent contaminant particles which are introduced into the ink jet head during assembly, or large agglomerations of small particles which can pass through the reservoir filter and accumulate, from becoming lodged in and blocking an orifice.

One possible approach to solving the orifice-clogging problem is to place a filter at the inlet to the pumping chambers of the head where it will block orifice-size contaminant particles without interfering with the pressure pulse transmitted from the pumping chamber to the orifice to eject a drop from the orifice. This approach, however, has several drawbacks. First, since the pressure chamber is refilled with ink after drop ejection as a result of the relatively low negative pressure generated by the meniscus in the orifice, only a small pressure drop can be tolerated across a filter in the passage leading from the ink reservoir to the pressure chamber. Typically, such a filter must be designed to provide a pressure drop substantially less than half the meniscus pressure, for example, about 10% of the meniscus pressure. Second, a filter in the passage leading to the pressure chamber will inevitably trap air bubbles which cannot pass through the filter until a pressure greater than the bubble pressure is applied across the filter, which does not normally occur in the absence of purging. Third, a filter designed to produce a low pressure loss will generally have a low flow rate, which may make it susceptible to loading by poorly-dispersed ink components or contaminant particles which are smaller than the pore size of the filter.

SUMMARY OF THE INVENTION

Accordingly, it is an object of the present invention to provide a new and improved filter arrangement for an ink jet head which overcomes the above-mentioned disadvantages of the prior art.

Another object of the invention is to provide a filter arrangement for an ink jet head which substantially eliminates blocking of ink jet orifices by particles contained or formed within the head.

These and other objects of the invention are attained by providing an ink jet head having an ink reservoir, a pumping chamber supplied with ink from the ink reservoir and an orifice plate with an orifice of selected diameter to produce an ink drop in response to pressure generated in the pressure chamber, and an orifice filter disposed between the pressure chamber and orifice in the orifice plate having a pore size smaller than the size of the orifice in the orifice plate. Preferably, to provide minimum pressure loss, the orifice filter has a pore size approaching the diameter of the orifice, for example, from 30%–100% of the orifice diameter and, more desirably, 75%–90% of the orifice diameter, to permit any contaminants significantly smaller than the orifice diameter to pass through the orifice filter while trapping contaminants approximating the size of the orifice.

In this way, the limitation on filter resistance imposed by the meniscus-driven pumping chamber refill fluid dynamics of the ink jet head is avoided since the orifice filter is located downstream from the pumping chamber and its resistance may therefore be lumped with the higher pumping chamber and orifice resistances. Thus, if the resistance of the orifice filter disposed between the pumping chamber and the orifice is smaller than that of the pumping chamber and the orifice, it should have a negligible impact on the pumping chamber refill and therefore the jetting performance of the ink jet head.

Furthermore, in addition to trapping orifice-size particles before they reach the orifice, a filter located immediately adjacent to the ink jet orifice has the further advantage that it provides a capillary barrier to depriming of the orifice because its high bubble pressure prevents loss of the meniscus at the orifice. Also, because it is between the pumping chamber and the orifice, the filter is subjected to liquid flow in opposite directions at relatively high rates during the fill-and-fire cycle of the pumping chamber, which should be effective to prevent loading of the filter with anything except the largest particles which could block the orifice.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENT

Figure 1:
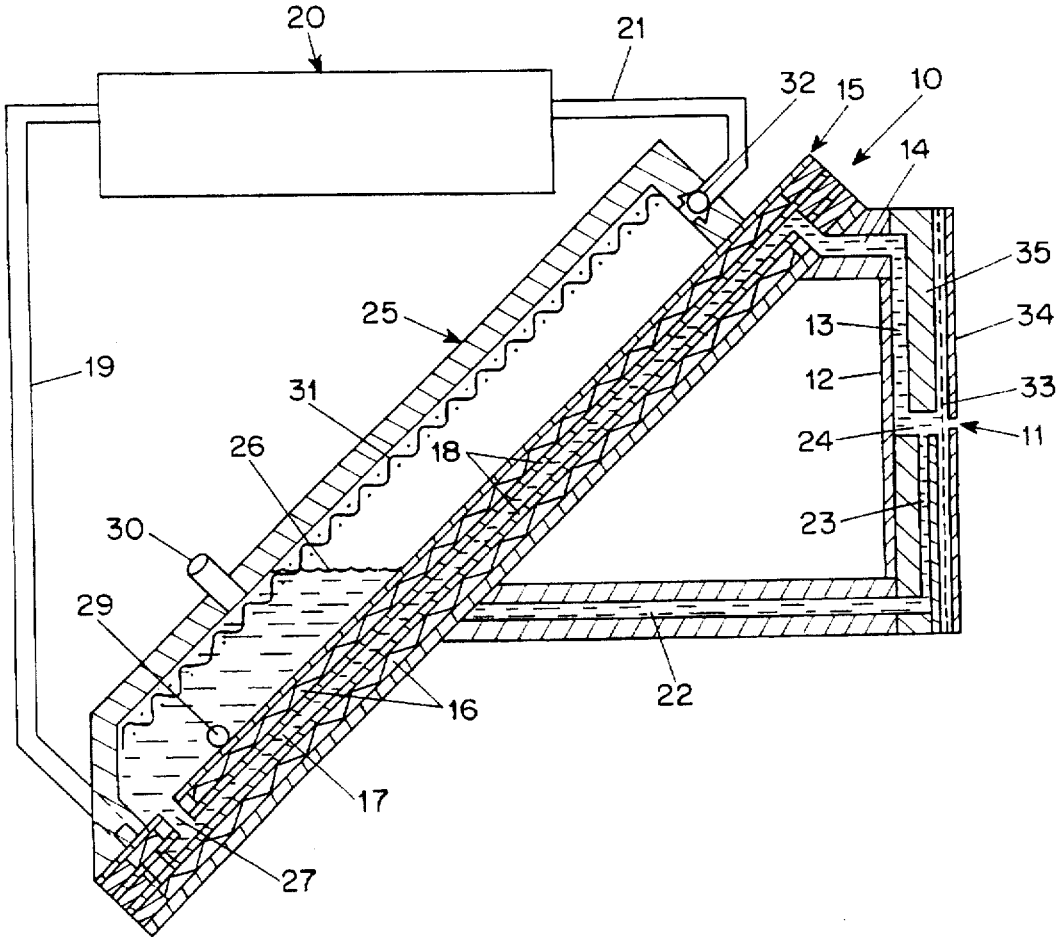
FIG. 1 is a schematic sectional side view of a representative embodiment of an orifice filter arrangement for an ink jet head in accordance with the invention.

In the typical embodiment of the invention schematically illustrated in FIG. 1, an ink jet head 10 has a series of orifices 11, only one of which is visible in the sectional view of FIG. 1, through which drops of ink are ejected in the usual manner in response to selective actuation of the portion of an electromechanical transducer 12 adjacent to a pressure chamber 13 containing ink. Ink is supplied to the pressure chamber 13 through a conduit 14 leading from a deaerator 15 of the type described, for example, in the Hine et al. U.S. Pat. No. 4,940,995, which is incorporated by reference herein. As described in that patent, negative pressure is applied to vacuum plenums 16 on opposite sides of an ink path 17 bounded by air-permeable, ink-impermeable membranes 18 in the deaerator to extract dissolved air from the ink, the vacuum plenums being connected through a line 19 to a pump unit 20 which is also arranged to apply positive air pressure through a line 21 for purging purposes.

When the pressure chamber 13 is inactive, i.e., not being contracted to eject ink drops through the orifice 11, deaerated ink passes from the deaerator 15 through a conduit 22 to a flow-through passage 23 and an orifice passage 24 back to the pressure chamber 13 so as to circulate the deaerated ink back to the pressure chamber, thereby avoiding the formation of bubbles when negative pressure is applied by the transducer 12 to the ink in the chamber 13 during operation of the system.

A reservoir 25 containing a supply of ink 26 is connected through an aperture 27 to the deaerator passage 17 so as to supply ink to the deaerator as the ink drops are ejected through the orifice 11 during operation of the system. When a low ink level in the reservoir 25 is detected by a low-ink detector 29, the ink in the reservoir 25 is replenished through a line 30 from a remote ink supply.

The ink jet orifice 11 is designed to project an ink drop having a selected small volume which depends upon the type of system in which the ink jet head is utilized, and the orifice may have a diameter of, for example, about 0.020 mm to 0.060 mm. In order to prevent contaminants in ink supplied from the remote supply through the line 30 to the reservoir 25 from being distributed in the ink in the reservoir and in the passages in the ink jet head, a reservoir filter 31 having an area substantially coextensive with the longitudinal cross-sectional area of the reservoir is positioned adjacent to one wall of the reservoir so as to intercept all of the ink introduced through the line 30.

Conventionally, the filter 31 has a pore size substantially smaller than the diameter of the orifices 11 in the head, for example, 0.002 to 0.010 mm, so as to trap all contaminants which might accumulate to form larger particles approximating the size of the orifices 11 and block the orifices or otherwise interfere with the operation of the system. Despite the presence of the filter 31, however, it is still possible for contaminant particles to block the orifices 11, either by way of introduction of particles through an air vent 32 through which air is drawn into the reservoir as the ink 26 is used, or because such particles become introduced and are trapped in the ink passages such as the ducts 14, 17, 22, 23 and 24 in the ink jet head during assembly of the head. Although the observance of extensive clean-room procedures during the manufacture of the ink jet head can reduce the possibility of such contaminant particles being incorporated into the head, it cannot completely eliminate that possibility.

Consequently, in accordance with the invention, an orifice filter 33 is incorporated into the ink jet head in the orifice passage 24 between an orifice plate 34 containing the orifices 11 and the adjacent portion of the ink jet head 35 containing the passages through which ink flows to the orifices during operation. The orifice filter 33 has a pore size selected to trap only those particles which might clog the orifices 11 while permitting smaller particles to pass through, thereby avoiding substantial pressure losses. Thus, the size of the pores in the orifice filter 33 must be smaller than the orifice size but larger than the pores in the reservoir filter 26 and is preferably about 30%–100% and, desirably, about 75%–90% of the diameter of the orifice 11. Accordingly, if the ink being ejected through the orifice contains particles smaller than the pore size, they will not be blocked by and will not tend to clog the orifice filter 33, but instead will be ejected with the ink drop passing out of the orifice 11, thereby reducing the tendency of the filter 33 to become clogged and produce an undesirable pressure drop.

In the preferred embodiment, the filter material is selected for compatibility with the ink and printhead fabrication processes. For example, the material may be etched or electroformed out of a metal such as nickel, gold or copper. Alternatively, the filter may be laser-machined from a polymer film such as polyimide or Teflon.

With this arrangement, the pressure drop is thus minimized and the presence of the orifice filter 33 will reduce the velocity of a drop ejected through the orifice by only about 5%–10% which, if necessary, can be compensated by appropriate adjustment of the actuation of the transducer 12.

Figure 2:
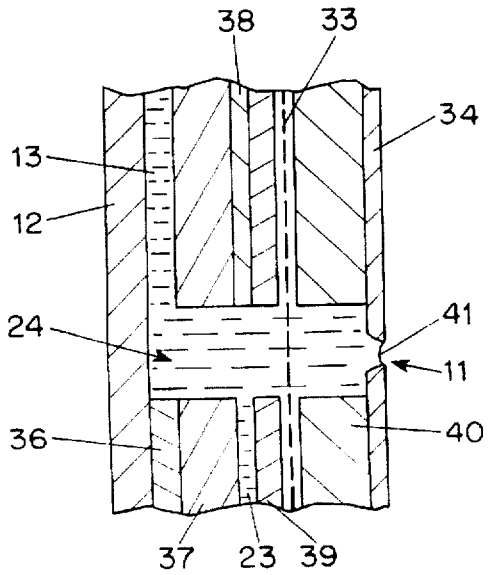
FIG. 2 is a schematic fragmentary sectional view illustrating an orifice filter arrangement in greater detail.

FIG. 2 illustrates an arrangement of an orifice filter in the orifice passage in greater detail. In this case, the ink passages in the head are formed by a series of adjacent plates having appropriate openings or channels which are sandwiched together. Thus, for example, the pressure chamber 13 is formed in a cavity plate 36 disposed adjacent to a stiffener plate 37 and the flow-through passage 23 is formed in a flow-through plate 38. In addition, the orifice filter 33 is mounted between a membrane plate 39 and a shim 40 to which the orifice plate 34 is affixed. The shim 40 may, for example, be made of pyrolytic carbon to provide high thermal conductivity which facilitates the transfer of heat to hot melt ink in the orifice passage 24 to as to maintain it at the desired temperature for drop ejection.

If the meniscus 41 in the orifice 11 is drawn back into the orifice passage 24 during refill of the pressure chamber 13 or for any other reason, the filter 33 is also effective to prevent the meniscus from forming a bubble which could move through the passage 24 into the pressure chamber 13 and interfere with the proper operation of the system. Moreover, because the ink in the passage 24 flows first in one direction during ejection of a drop and then in the opposite direction during refilling of the pressure chamber 13 at relatively high flow velocities, accumulation and loading of the filter 33 with smaller particles which would not tend to block the orifice 11 is effectively prevented.

Although the invention has been described herein with reference to a specific embodiment, many modifications and variations therein will readily occur to those skilled in the art. Accordingly, all such variations and modifications are included within the intended scope of the invention.

I claim:

1. An ink jet head comprising a pressure chamber, an orifice plate having an orifice of selected diameter, an ink passage extending from the pressure chamber to the orifice, a filter in the passage between the pressure chamber and the orifice having a pore size small enough to retain contaminant particles which could block the orifice, wherein the filter in the passage has a pore size from approximately 30% to less than 100% of the diameter of the orifice, a reservoir for supplying ink to the pressure chamber and a filter in the reservoir having a pore size smaller than that of the filter in the passage leading from the pressure chamber to the orifice.

2. An ink jet head according to claim 1 wherein the orifice has a diameter in the range from about 0.020 mm to about 0.060 mm.

3. An ink jet head according to claim 2 wherein the filter has a pore size approximately 75% to 90% of the diameter of the orifice.

4. An ink jet head according to claim 2 including deaeration means for extracting dissolved air from ink supplied to the pressure chamber.

5. An ink jet head according to claim 2 wherein the filter in the reservoir has a pore size approximately 10% to 30% of the diameter of the orifice.

6. An ink jet head according to claim 2 including pump means for applying purging pressure to the ink in the reservoir.

* * * * *